United States Patent [19]

Ruger

[11] Patent Number: 4,860,480

[45] Date of Patent: Aug. 29, 1989

[54] FIREARM RECEIVER INCLUDING SCOPE MOUNT ARRANGEMENT

[75] Inventor: William B. Ruger, Croydon, N.H.

[73] Assignee: Sturm, Ruger & Company, Inc., Southport, Conn.

[21] Appl. No.: 140,507

[22] Filed: Jan. 4, 1988

[51] Int. Cl.[4] ..... F41G 1/38

[52] U.S. Cl. ..... 42/101; 33/245

[58] Field of Search ..... 42/101; 33/245–250; 24/1.1

[56] References Cited

U.S. PATENT DOCUMENTS

| | | | |
|---|---|---|---|
| 2,151,768 | 3/1939 | Humeston | 33/245 |
| 2,193,094 | 3/1940 | Gilbert | 33/245 |
| 2,576,007 | 11/1951 | Fischer et al. | 33/248 |
| 2,717,447 | 9/1955 | Leupold | 42/101 |
| 3,292,264 | 12/1966 | Kincannon | 33/245 |
| 3,299,558 | 1/1967 | Karl | 42/101 |
| 3,424,420 | 1/1969 | Seiderman | 42/101 |
| 3,463,430 | 8/1969 | Rubin et al. | 33/245 |
| 3,491,975 | 1/1970 | Weaver | 42/101 |
| 3,785,603 | 1/1974 | Apel | 42/101 |
| 4,121,363 | 10/1978 | York | 42/101 |
| 4,688,345 | 8/1987 | Kilgour | 42/101 |

*Primary Examiner*—Deborah L. Kyle
*Assistant Examiner*—Michael J. Carone
*Attorney, Agent, or Firm*—Pennie & Edmonds

[57] ABSTRACT

Broadly, the present invention is a telescopic base mount arrangement integrally formed by casting or other process with the receiver for the mounting and holding a telescope sight close to the barrel together with clamp engagement means.

4 Claims, 4 Drawing Sheets

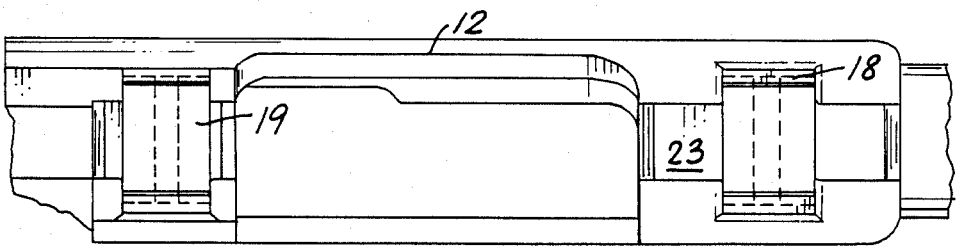
FIG. 4
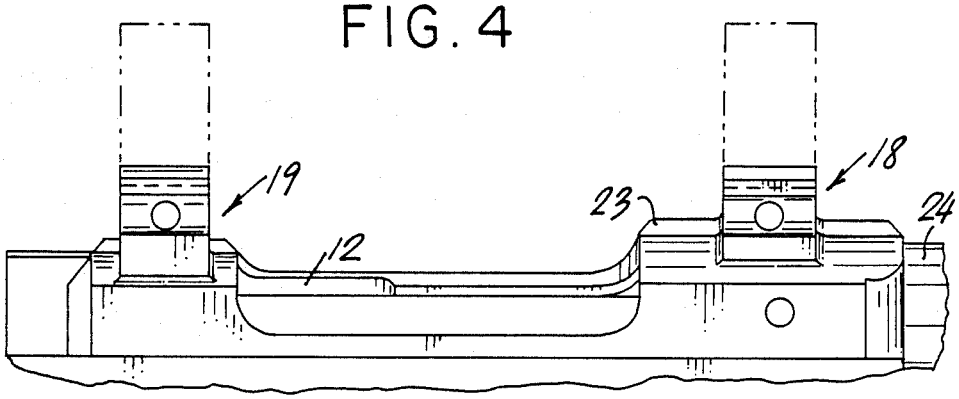
FIG. 5
FIG. 6
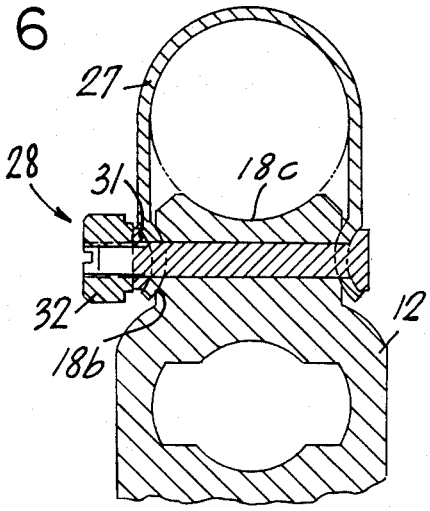
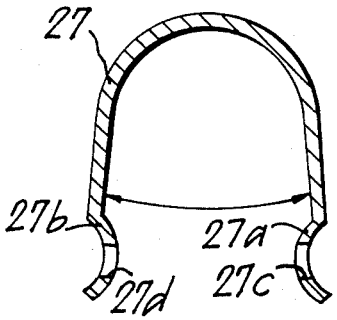
FIG. 7

FIREARM RECEIVER INCLUDING SCOPE MOUNT ARRANGEMENT

BACKGROUND OF THE INVENTION

Telescopic scope mounts for firearms have included mounting bases attachable to the receiver of the firearm (see U.S. Pat. No. 4,121,363 to York) and sight supports integrally formed in a frame encircling the firearm barrel to which the mounting bases are attached (U.S. Pat. No. 3,288,538).

None of the prior art scope mounts have satisfactorily provided for more complete rigidity, proper alignment, compact low telescopic sight mounting, and ready detachability when the scope is not in use, since either the mounting bases or the sight supports must be removable from the firearm in all prior art, usually by unscrewing relatively small mounting screws.

SUMMARY OF THE INVENTION

Broadly, the present invention is a telescopic base mount arrangement integrally formed by casting or other process with the receiver for mounting and holding a telescope sight close to the barrel together with clamp engagement means.

BRIEF DESCRIPTION OF THE DRAWINGS

FIG. 4 is a partial plan view of the rifle showing the scope mounts;

FIG. 5 is a partial side elevational view of the scope mounts;

FIG. 6 is a sectional view taken along line 6—6 of FIG. 1;

FIG. 7 is a sectional view of a scope clamp;

DESCRIPTION OF THE PREFERRED EMBODIMENT

Figure 3:
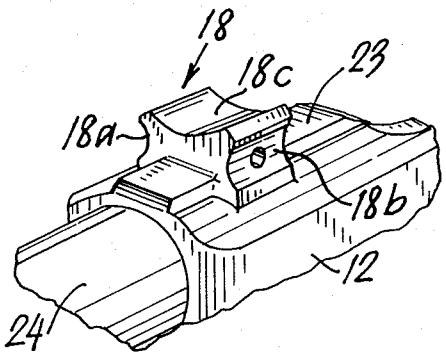
FIG. 3 is a partial perspective view of a single scope mount.

With reference to the Figures, rifle 10 includes stock 11, receiver 12, trigger guard 14, stock 15 and trigger 16. Also shown is bolt 17 and bolt handle 17a, forward scope mount block 18, rearward scope mount block19 and scope 22. Receiver 12 carries integral longitudinal forward receiver rib 23 and forward and rearward scope mount blocks 18, 19 formed integrally with receiver 12. Also shown in FIG. 3, forward of receiver 12, is rounded stock portion 24. Mount blocks 18, 19 are integrally formed as part of receiver 12, by casting, forging or otherwise. Mount blocks 18 and 19 are aligned with the receiver 12 as fabricated and cannot move relative to receiver 12 due to loosening of fasteners or distortion of the mounts from stresses on fasteners or other forces.

Figure 9:
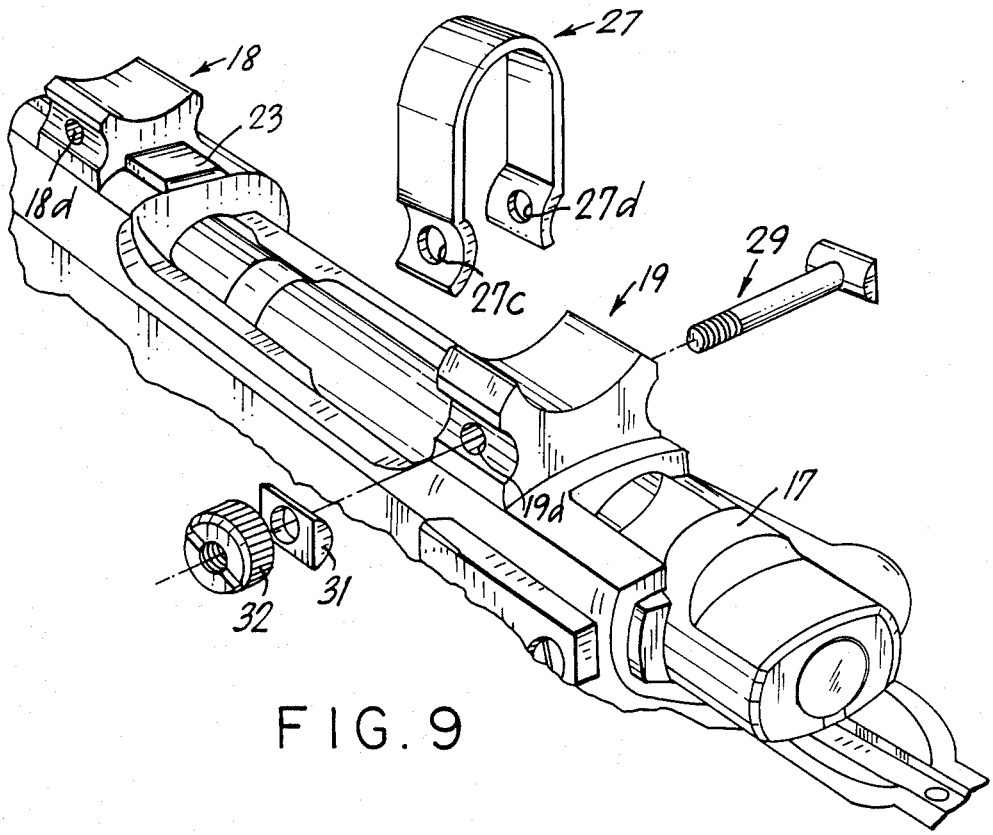
FIG. 9 is a partial perspective view of the scope mounts showing a scope clamp in exploded view.
Figure 8:
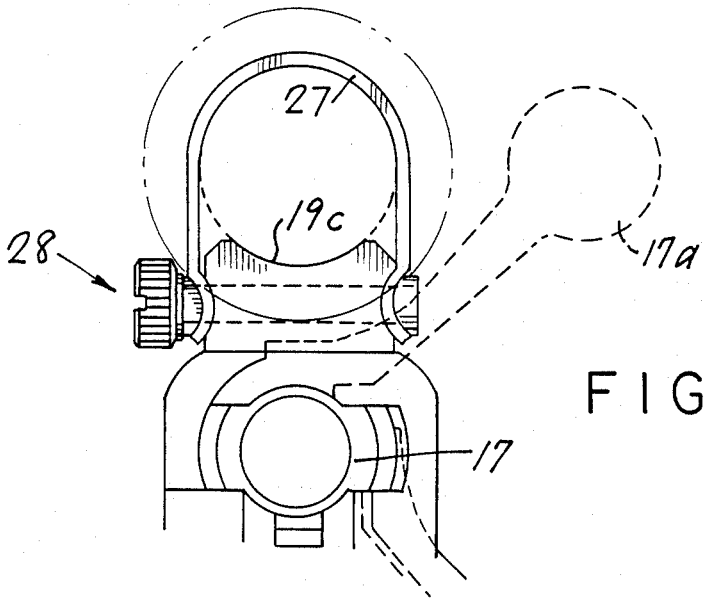
FIG. 8 is a sectional view showing, from the rear of the mount, the bolt handle for operating the rifle bolt.

Mount blocks 18, 19 have right side arcuate depressions **18*a*, 19*a*; left side arcuate depressions 18*b*, 19*b* and top arcuate depressions 18*c*, 19*c*. Depressions 18*c*, 19*c* are shaped and formed in alignment so that the scope is properly held and oriented. Turning to FIGS. 6, 8 and 9, it is seen that flexible clamp strap 27 has arcuate end portions 27*a*, 27*b*, for securing to side mount depressions 18*a*, 18*b*, and 19*a*, 19*b* using a three (3) piece fastener assembly 28. Fastener assembly 28 includes curved head threaded bolt 29, curved washer 31 and threaded nut 32. Bolts 29, including their stems 30, pass through block passages 18*d*, 19*d* and clamp holes, 27*c*, 27*d***.

Figure 1:
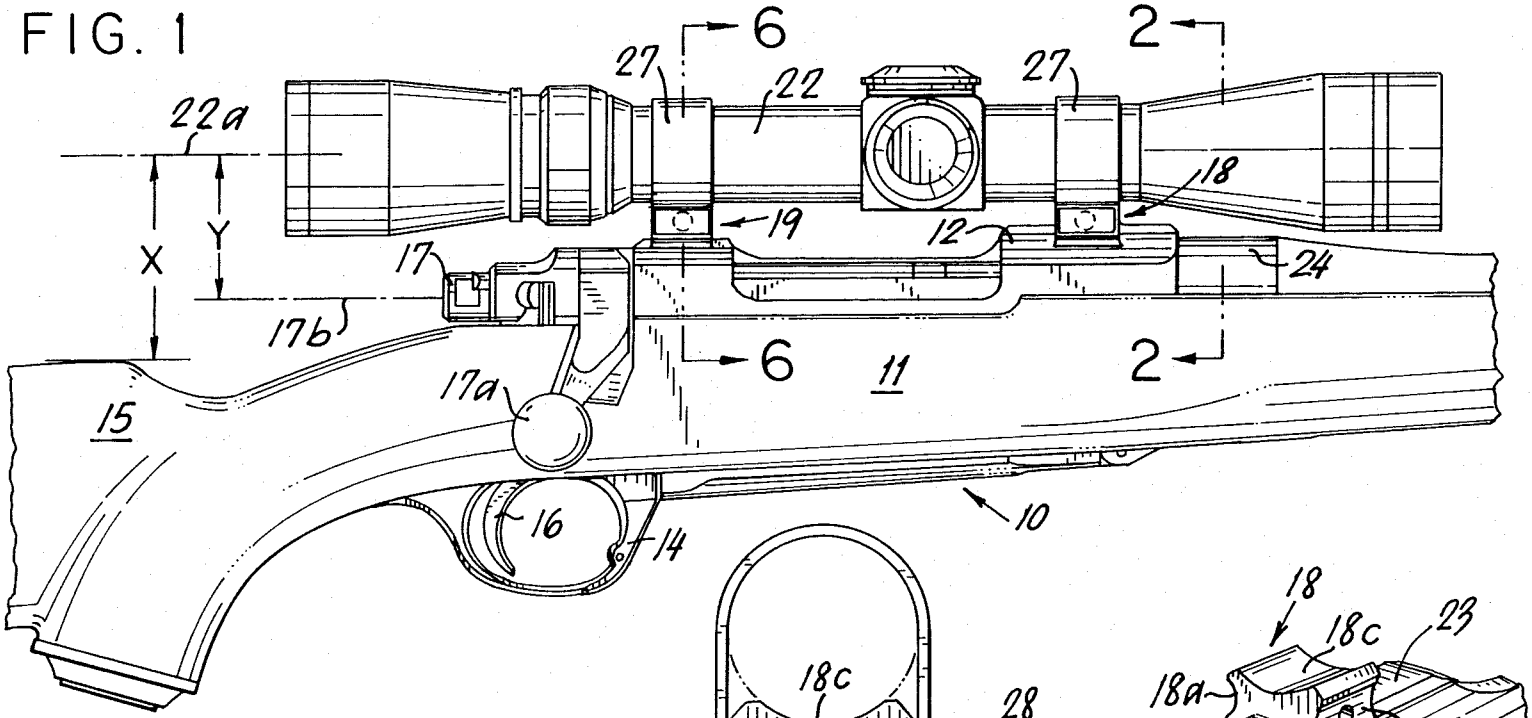
FIG. 1 is a partial right side elevational view of the scope mounts of this invention in a bolt action rifle.
Figure 2:
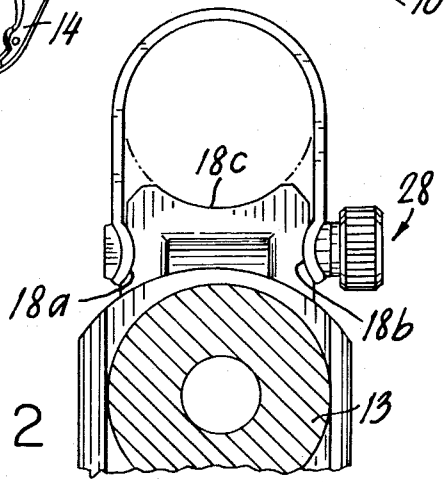
FIG. 2 is a sectional view taken along line 2—2 of FIG. 1.

An advantage of the present receiver with mount blocks 18, 19 is to accomplish mounting of scope 22 as close to the centerline of the barrel (not shown but the same as axis **17*b* of bolt 17; FIG. 1). The present invention accomplishes lower mounting of scope 22 since compactness and adequate strength can be attained in a smaller space. The distance Y between axis 22*a* of scope 22 and axis 17*b* is made as short as practical so that sighting is made easier and more accurate. Distance X is measured between line 22*a* and stock 15**.

Figure 10:
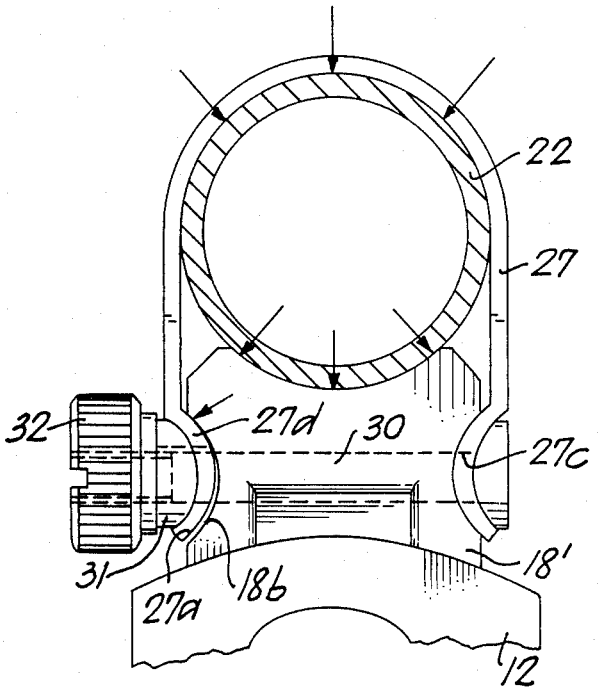
FIG. 10 is an enlarged sectional view of a clamp being attached.
Figure 11:
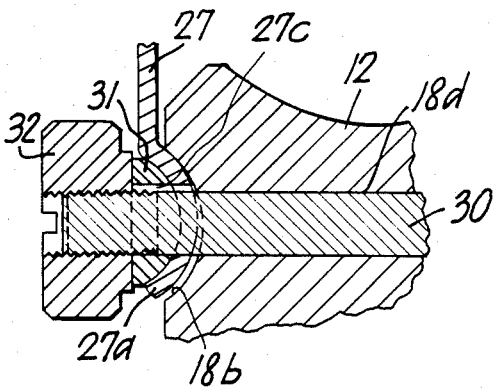
FIG. 11 is a partial sectional view of a clamp being attached.

Finally, with respect to FIGS. 10 and 11, clamp 27 strap is shown with left strap end hole **27*c* having a slightly larger diameter than the diameter of bolt stem 30 so that strap 27 can be placed on bolt stem 30 and around the scope 22 under relatively small or no tension. When washer 31 is forced against strap end 27*a* by tightening threaded nut hole 32 to engage end portion 27*d* forcing it to conform with recess 18b of mount 18 and thus to be pulled down on and thereby tension strap 27 against scope 22**.

I claim:

1. A firearm receiver including a scope mount comprising (a) a plurality of spaced-apart metallic block portions integrally formed with a metallic receiver;

(b) a top surface on each block portion;

(c) strap engagement means for engaging the scope to said block portions which means is detachably connected to each such block portion; and (d) side depression means in said block portions for accommodating said scope strap engagement means;

whereby the strap means and the block portions are connected together to mount and hold the scope.

2. The firearm receiver of claim 1 in which each block portion top surface has top depression means for receiving the scope and in which the top depression means are formed and aligned to properly orient the scope.

3. The firearm receiver including scope mount of claim 1 in which the strap engagement means includes curved end portions, a threaded bolt and a threaded nut configured to nest in and engage the curved end portions when tightened on the threaded bolt.

4. A firearm receiver including a scope mount comprising (a) a plurality of spaced-apart block portions integrally formed with the receiver;

(b) strap means having curved end portions, a threaded bolt and a threaded nut configured to nest in and engage the curved end portions when tightened on the threaded bolt;

(c) side depression means in said block portions for accommodating said scope strap engagement means;

whereby the strap means and the block portions are connected together to mount and hold the scope.

* * * * *